US007255143B1

(12) United States Patent
Babcock et al.

(10) Patent No.: US 7,255,143 B1
(45) Date of Patent: Aug. 14, 2007

(54) QUAD WEDGE TIP UP LOG SPLITTER

(75) Inventors: Stephen E. Babcock, Lakeville, MN (US); Timothy C. Rancourt, Faribault, MN (US)

(73) Assignee: Northern Tool & Equipment Company, Inc., Burnsville, MN (US)

( * ) Notice: Subject to any disclaimer, the term of this patent is extended or adjusted under 35 U.S.C. 154(b) by 0 days.

(21) Appl. No.: 11/490,660

(22) Filed: Jul. 21, 2006

(51) Int. Cl.
*B27L 7/00* (2006.01)

(52) U.S. Cl. ..... 144/195.1; 144/4.6; 144/193.1

(58) Field of Classification Search ..... 144/193.1, 144/195.2, 195.6, 195.1, 195.8, 4.6, 366, 144/195.7
See application file for complete search history.

(56) References Cited

U.S. PATENT DOCUMENTS 3,285,304 A * 11/1966 Fuller ..... 144/193.1
3,779,295 A * 12/1973 Balsbaugh ..... 144/195.1
3,974,867 A * 8/1976 Butas, Jr. ..... 144/195.1
4,275,779 A * 6/1981 Rowe ..... 144/195.1
4,412,570 A * 11/1983 Nickerson ..... 144/195.1
4,453,580 A * 6/1984 Patten ..... 144/195.1
4,561,479 A * 12/1985 Burdine ..... 144/195.2
4,667,712 A * 5/1987 Hudson et al. ..... 144/195.1
4,700,759 A * 10/1987 Duerr ..... 144/195.1
4,782,870 A * 11/1988 Duerr ..... 144/195.1
4,961,452 A * 10/1990 Hudson ..... 144/195.1
5,337,810 A * 8/1994 McCormack ..... 144/195.1
5,526,855 A * 6/1996 Graham ..... 144/195.1

* cited by examiner

*Primary Examiner*—Bena Miller
(74) *Attorney, Agent, or Firm*—Oppenheimer Wolff & Donnelly LLP

(57) ABSTRACT

A uniquely configured quad wedge allows for the creation of a tip-up log splitter that is capable of multiple splits in a single stroke of the drive mechanism. The quad wedge is attached to the piston of a hydraulic cylinder, and is slidably mounted to a framework to allow for movement through a splitting zone. The quad wedge further includes a main splitting blade, along with a pair of splitting wings extending outwardly in a perpendicular manner. The blades each have structures on the ends thereof which are configured to help contain a log during splitting operations, thus avoiding undesired movement or wandering. The log splitter further includes a stripper mechanism positioned near the cylinder housing to allow jammed logs to be easily removed, which includes a recess to house the quad wedge when retracted. A jammed log will necessarily contact the stripper mechanism, causing it to be removed from the blade.

32 Claims, 10 Drawing Sheets

QUAD WEDGE TIP UP LOG SPLITTER

BACKGROUND

The present invention pertains to a log splitter. More specifically, the present invention relates a tip up log splitter having a quad splitting wedge positioned on an extendable hydraulic cylinder to allow the quad splitting wedge to be forcibly pushed through a log. A splitter of this configuration easily allows splitting multiple directions using a single stroke of the hydraulic cylinder.

Log splitting devices have been in use for decades. Conventional log splitting devices typically include a stationary support frame configured to support a hydraulic cylinder and a cooperating splitting wedge. In a fixed wedge version, the splitting wedge is fixed to the supporting frame, and the log is forced into the splitting wedge. In use, a log is placed in the appropriate position and is forcibly pushed against the stationary splitting wedge by the force created when the hydraulic cylinder is extended. Obviously, this requires movement or sliding of the log in order to create the desired split. This required movement necessarily requires that this type of splitter be positioned in a horizontal manner to allow space for the log to move past the wedge. In an alternative version, the splitting wedge is attached to the hydraulic cylinder and is forced through the log. In this case, the log is held in place by some type of stop, thus allowing the force of the hydraulic cylinder to force the splitting wedge through the log.

In addition, log splitters are also broken into two categories based upon their orientation during operation—horizontal splitters and vertical splitters. Generally speaking, horizontal splitters require logs to be positioned horizontal and roughly parallel to the surface on which the log splitting device is set. Horizontal splitters work well for smaller, lighter logs. However, horizontal splitters can be inconvenient to use when splitting large, heavy pieces of wood. Operators must lift heavy and irregular shaped logs in order to position them in horizontal splitters. This creates safety hazards to operators as well as inefficiencies in the splitting process. All fixed wedge splitters are required to operate in the horizontal orientation, to allow space for the log to exit past the wedge itself.

As mentioned above, some log splitting devices are designed so that the splitting wedge is driven through the log. These log splitting devices are equipped with knife-type splitting wedge that is pushed through the log. Again, the hydraulic cylinder is typically attached to a frame of some type, and has the splitting wedge attached thereto. The frame will also have a stop of some type to contain the log as the wedge is being advanced. One advantage of this system is the ability to operate in either a horizontal or a vertical orientation. To operate in a vertical orientation, the splitter is simply positioned so the stop is on the ground, and the cylinder motion is vertical. This allows the log to remain on the ground (or placed on top of the stop plate that is already position on the ground), thus eliminating the need for the operator to lift or move potentially heavy pieces of wood. Vertical splitters are better suited for large, heavy logs because logs can be slightly elevated at one end in order to position them on a base plate of the log splitting device and then "walked" side-to-side onto a base platform where they can be positioned for cutting. Vertical splitters may be excessively tall and top-heavy however, making them unstable to operate and transport. To address this problem, the tip-up splitter was introduced which allows transportation in a horizontal orientation, and use in either orientation.

One issue related to all splitters is the efficiency of operation. As mentioned above, most classical splitters have used a single edge cutting wedge. This type of wedge simply allows for the splitting of a single piece into two separate pieces. In many situations however, it is desired to "quarter" a log into four separate pieces. In many cases, this quartering simply results in log sizes which are more convenient and desirable. Unfortunately, an operator is required to undergo several separate "splits" in order to achieve this.

One approach to the desired multiple splits is the use of a more complex splitting blade. Specifically, a four way splitting blade has been used in conjunction with fixed blade splitters to achieve multiple splits in one stroke of the hydraulic cylinder. In this case, the splitting blade is configured in a cross format, with vertically and horizontally oriented blade portions. Similar to the fixed blade splitters discussed above, this four way splitting blade is attached to the framework and the cylinder will simply push the log into an through this blade. One of the problems associated with these types of devices is that logs can easily become jammed between the framework plate and the splitting wedge. Specifically, the log piece will jam between the horizontal portions and the framework plate. It can be very difficult for operators to clear these jams. In order to clear wood from the splitting wedge, operators often have to strike the wood with hammers or other tools. This creates a safety hazard to workers and also decreases the efficiency of the log splitting device.

In addition to the issues raised above, the four way splitting devices have also had issues trying to effectively contain the wood during splitting. As would be anticipated, the log will tend to wonder or drift away from the splitting blade. For example, the two quarters to the right of a horizontal blade will desire to move further to the right while being pushed past the four way splitting blade. If this moves too far, the log will be pushed off the end of the horizontal blade being used to attempt the additional split. When this happens, the log must be reloaded, and split again. This effectively defeats the purpose of the four way blade.

Based on the foregoing, there exists a need for a log splitting device that minimizes wood jamming and provides a means for clearing pieces of wood from the splitting wedge. In addition, there is a need for a log splitting device that can be easily and safely converted between a horizontal splitting position and a vertical splitting position depending on the size of wood being cut.

BRIEF SUMMARY OF THE INVENTION

The present invention addresses the above-mentioned need by providing a log splitting device which includes an efficient quad wedge capable of effectively performing multiple splits in a single action. The splitting device is further capable of operation in both a horizontal and vertical orientations, thus providing flexibility for the user. Further, the log splitting device incorporates a stripper mechanism to deal with those situations where logs jam or are wedged in the splitting device. This stripper allows for the removal of these wedge wood pieces without the potential for danger or injury to the user.

Generally speaking, the log splitter of the present invention includes a framework that is transportable using a towing vehicle of some type. Further, the framework is capable of being positioned in either a vertical orientation or a horizontal orientation, thus permitting log splitting operations in either orientation. Attached to the framework is a hydraulic cylinder to provide force necessary for splitting operations. The hydraulic cylinder is attached to a point on the framework which is in line with the cylinder's piston, thus allowing the most efficient transfer of forces.

To provide efficient splitting operations, the log splitter of the present invention includes a quad wedge which is driven through the log by the hydraulic cylinder. The quad wedge is attached to the driven end of the cylinder's piston, and is coupled to the framework. These connections allow the quad wedge to be driven by the hydraulic cylinder so as to slide along the framework. A stop is attached to the framework at a position opposite the piston and acts to hold the log in place during splitting. The cooperation of the quad wedge and the stop allow the splitting to occur, whereby the quad wedge is forced through the log.

The quad wedge of the present invention is uniquely configured to provide effective splitting, while also effectively dealing with loads and moments encountered during splitting. The quad wedge has a slidable base which is coupled to the framework to provide controlled movement. Extending upwardly from the slidable base is a main blade portion, which includes a curved cutting edge and a main blade body. The curved cutting edge is specifically configured to be the first part of the quad wedge which contacts the log to be split. In this manner, the quad wedge is allowed to make contact with the log a very localized area, thus easily starting the splitting operation while using a small amount of initial force. At the top of the main blade is a wood guide tip, which takes the form of a point extending from the upper portion of the main blade. The wood guide tip is configured to contain the log being split and prevent it from moving in an upward direction. The wood guide tip is configured to contact the log shortly after the first portion of the curved cutting blade.

To accommodate multiple splits during a single stroke of the cylinder, the quad wedge further includes a pair of splitting wings extending outwardly from the sides of the main blade body. Each splitting wing includes a curved blade portion, and a blade tip at the outward end. The curved blade starts at a position adjacent the main blade body and curves outwardly and toward the back of the quad wedge. In addition, the curved blade portion starts at a bottom surface of the blade wing and extends upwardly. In this manner, the bottom of the splitting wing remains substantially flat across its entire surface. The blade tips are configured as a point and create an inwardly sloped portion to help contain the log during splitting. Specifically, these blade tips help to keep the log from wandering outwardly during the splitting operations, thus helping to insure the successful splitting operation of the splitting wings.

The main blade and the cutting wings of the quad wedge also include a number of dimples and cooperating grooves. These structures help to reduce the overall mass of the blades as they pass through the log. This helps to reduce the amount of force necessary to accomplish the desired splits, and adds to the efficiency of the log splitter.

In addition to the structures outlined above, the log splitter also includes a very efficient log stripper to deal with jamming and wedging of log pieces. The log stripper is attached to the cylinder housing, and is positioned to receive the quad wedge when the piston is retracted. More specifically, the stripper is specifically configured with an opening to act as a garage for the quad wedge when retraced. The quad wedge uniquely fits within recesses in the stripper. This configuration causes any lodged wood to contact a stripper face when the quad wedge is retracted. In operation, when a jam is encountered the user will simply reverse the direction of the piston, causing the quad wedge to retract toward the stripper. As the quad wedge enters the recess in the stripper, the jammed log will encounter the stripper face, causing it to be pushed out of the quad wedge. In this manner, jammed logs can be easily cleared by the user without placing their hands or feet near the splitting blades. This obviously provides safety and helps to prevent injury. Additionally, the efficiency of the splitter is enhanced as jams can be removed without stopping the splitter or shutting it down.

The invention will be further described with reference to the following detailed description taken in conjunction with the drawings.

DETAILED DESCRIPTION OF THE INVENTION

Figure 1:
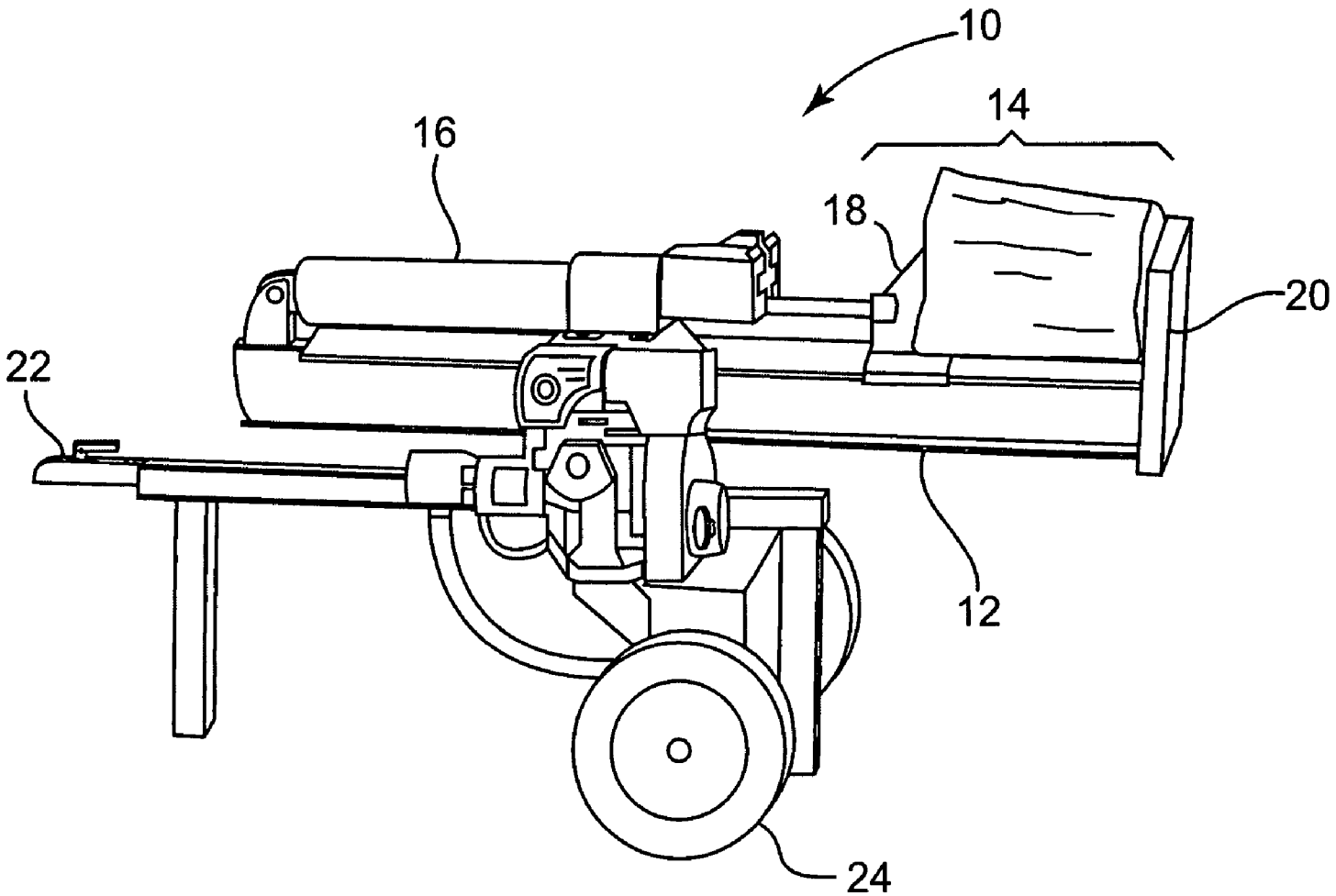
FIG. 1 is a front perspective view of a log splitting device in a horizontal orientation in accordance with the present invention.
Figure 2:
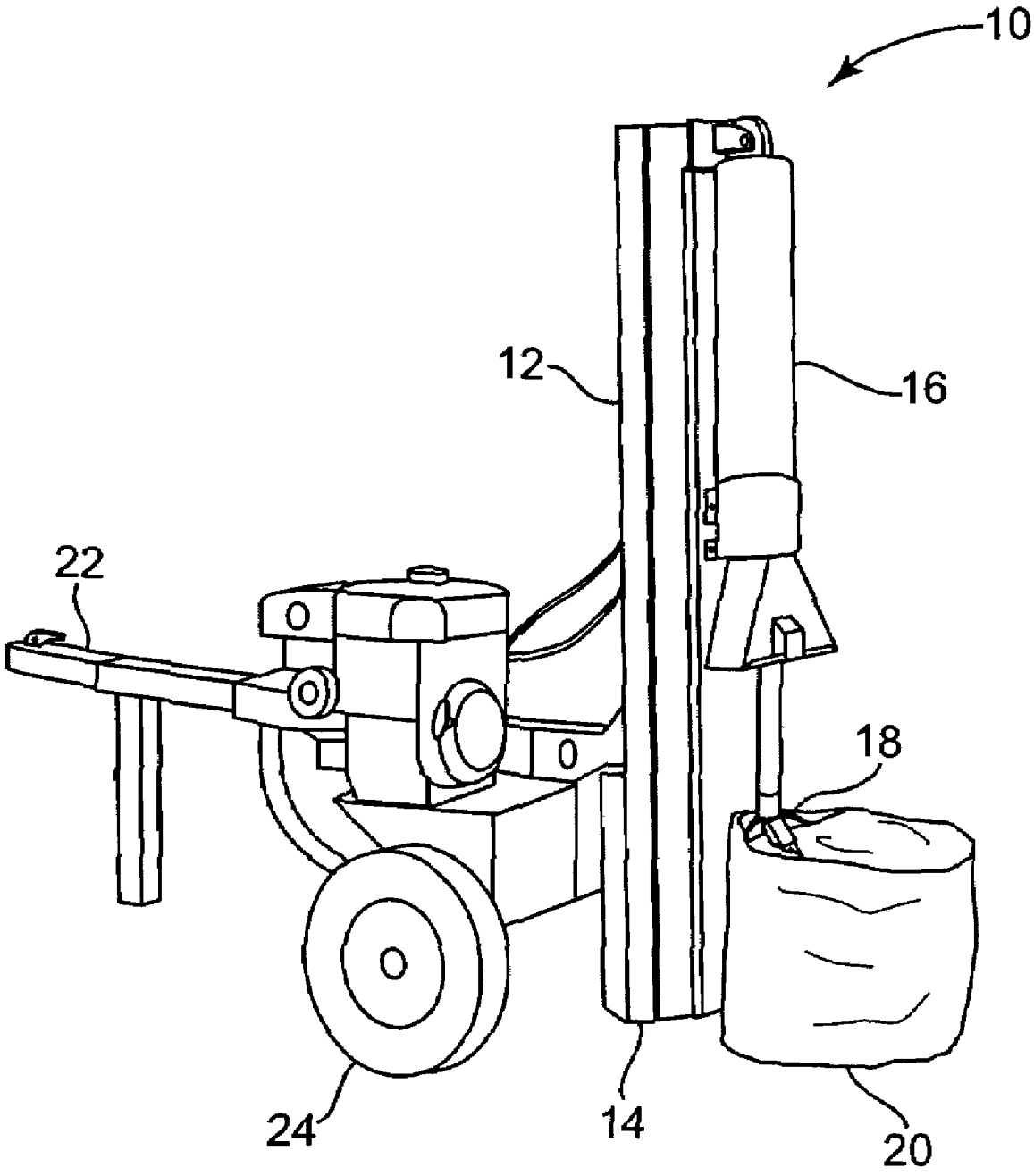
FIG. 2 is a perspective view of the log splitting device in a vertical orientation in accordance with the present invention.

Referring to FIG. 1, there is shown one embodiment of a quad wedge tip up log splitter 10 positioned in a horizontal orientation in accordance with the present invention. Similarly, FIG. 2 depicts log splitter 10 positioned in a vertical orientation. Log splitter 10, in both the horizontal and vertical orientations, includes a support framework 12 that forms a splitting zone 14, a drive mechanism 16 connected to support framework 12, a quad wedge 18 connected to drive mechanism 16, and a stop 20. Log splitter 10 shown in FIGS. 1 and 2 are trailer-type log splitters having a hitch 22 and wheels 24 in order to couple log splitter 10 to a transport vehicle, allowing the splitter to be moved from location to location. Those skilled in the art can appreciate that log splitter 10 can be stationary, variable in size and/or designed to be disassembled into smaller components for transportation, storage, etc. and reassembled when necessary for use.

Figure 3:
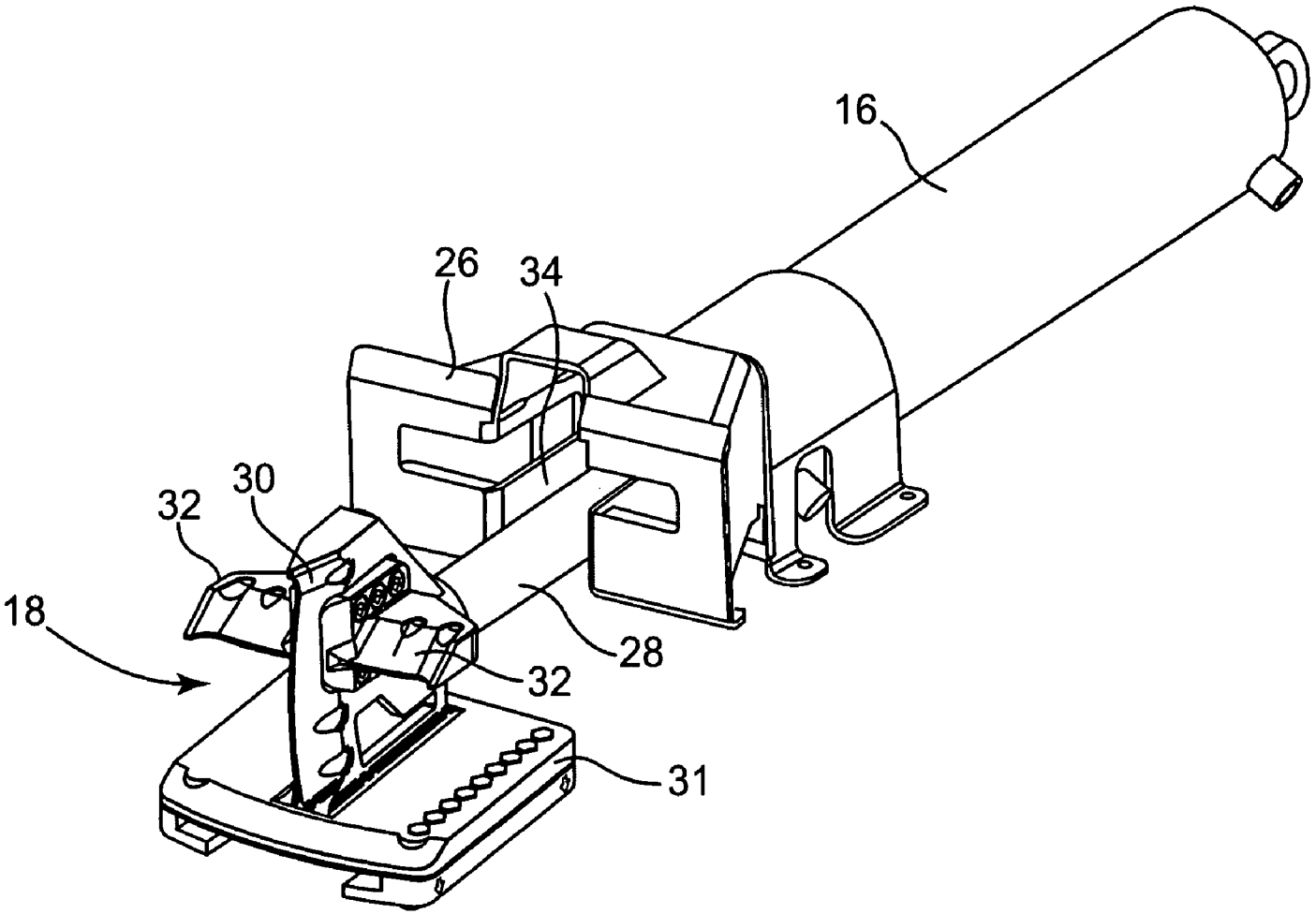
FIG. 3 is a perspective view of a quad wedge and cylinder assembly in a position extended away from a stripper of the present invention.

Referring now to FIG. 3 there is shown a more detailed view of quad wedge 18 in an extended position. It is easily appreciated that these components are attached or cooperating with the framework which is not shown. As shown, quad wedge 18 is connected to drive mechanism 16 which provides for controlled movement. Quad wedge 18 is more specifically connected to an extendable member 28 that is driven vertically or horizontally through splitting zone 14 (not shown). The figures depict drive mechanism 16 as a hydraulic cylinder and extendable member 28 as a piston. Those skilled in the art can appreciate that any type of mechanism can be used provided that it is capable of driving quad wedge 18 vertically or horizontally through a log. Some such drive mechanisms 16 may include, but are not limited to; wheel drives mechanisms, screw or worm drives, and the like.

Figure 4:
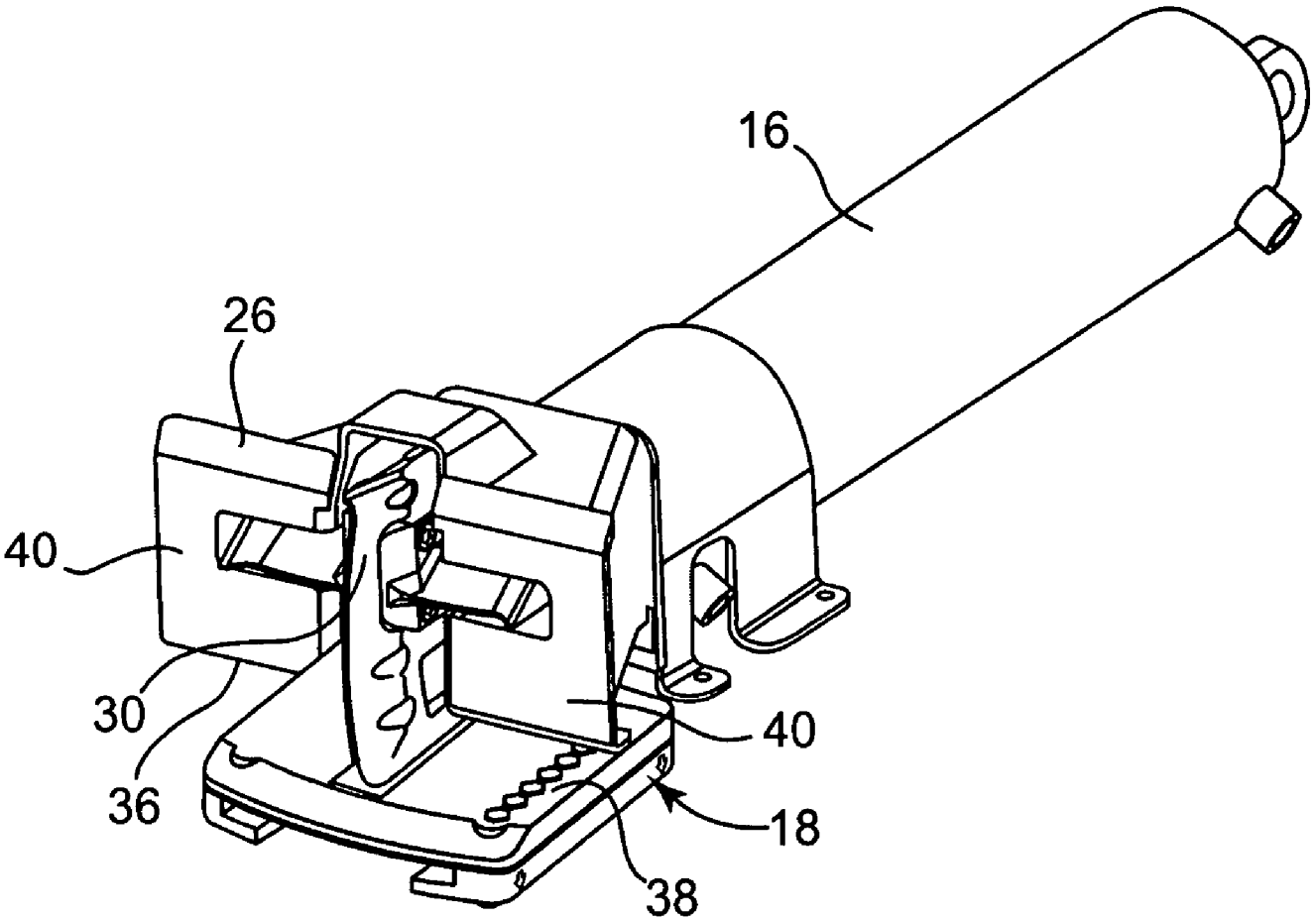
FIG. 4 is a perspective view of the quad wedge and cylinder assembly in a retracted position.

Quad wedge 18 has one main blade portion 30 supported by a slidable base 31. Two cutting wings 32 are mounted on opposite sides of main blade portion 30 such that cutting wings 32 extend perpendicular to main blade portion 30. Stripper 26 has a substantially cross-shaped area 34 for receiving quad wedge 18. FIG. 4 shows quad wedge 18 in a retracted position such that it is housed partially within stripper 26. Main blade portion 30 and cutting wings 32 are retracted within cooperating structures of stripper 26. Slidable base 31 extends below stripper 26 such that a bottom edge 36 of stripper 26 is above, but not contacting, a top surface 38 of slidable base 31. As discussed in further detail below, stripper 26 is very beneficial for dislodging any wood that is jammed or stuck in quad wedge 18.

Figure 5:
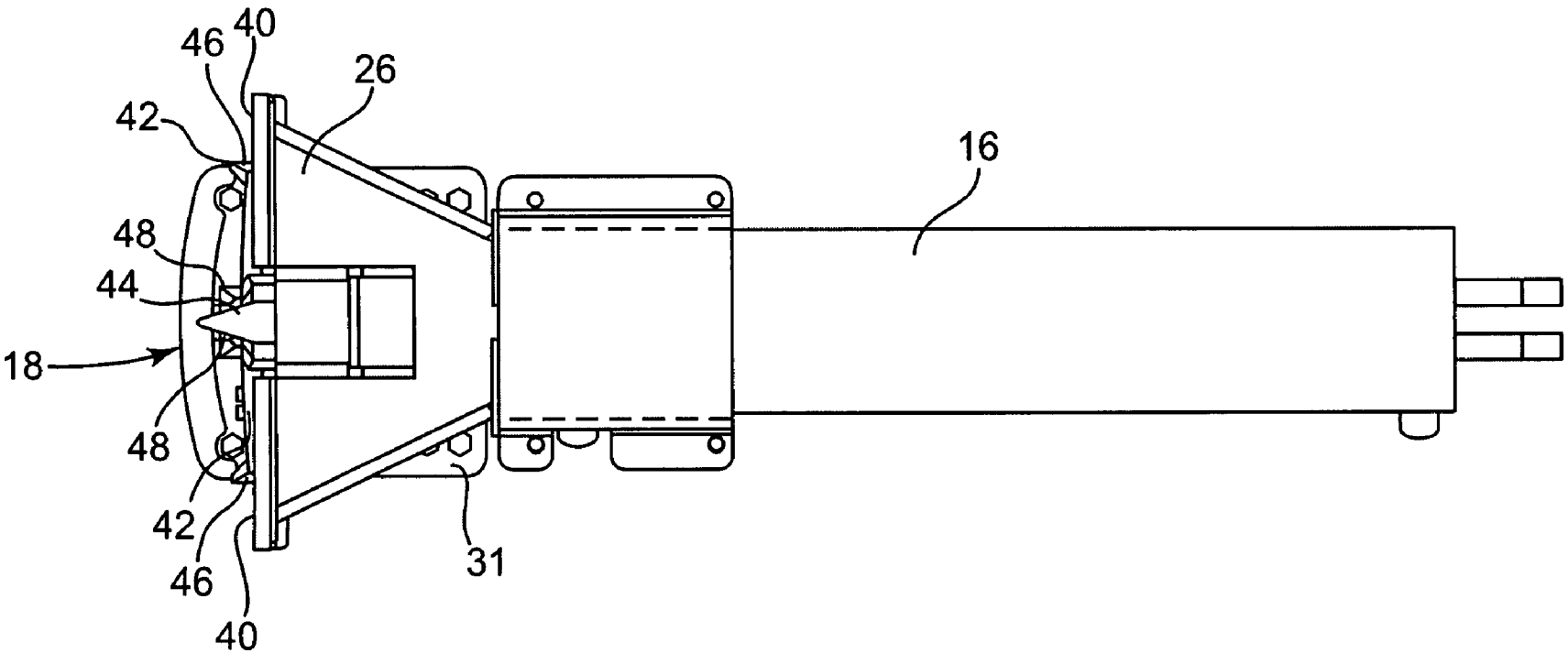
FIG. 5 is a top view of the quad wedge and cylinder assembly in the retracted position.

Referring now to FIG. 5, there is shown a top view of the quad wedge 18 retracted within stripper 26. Curved portions 42 of cutting wings 32 protrude slightly from flat surfaces 40 on stripper 26. A blade tip 44 on main blade portion 30 also protrudes slightly from flat surfaces 40 on stripper 26.

Figure 8:
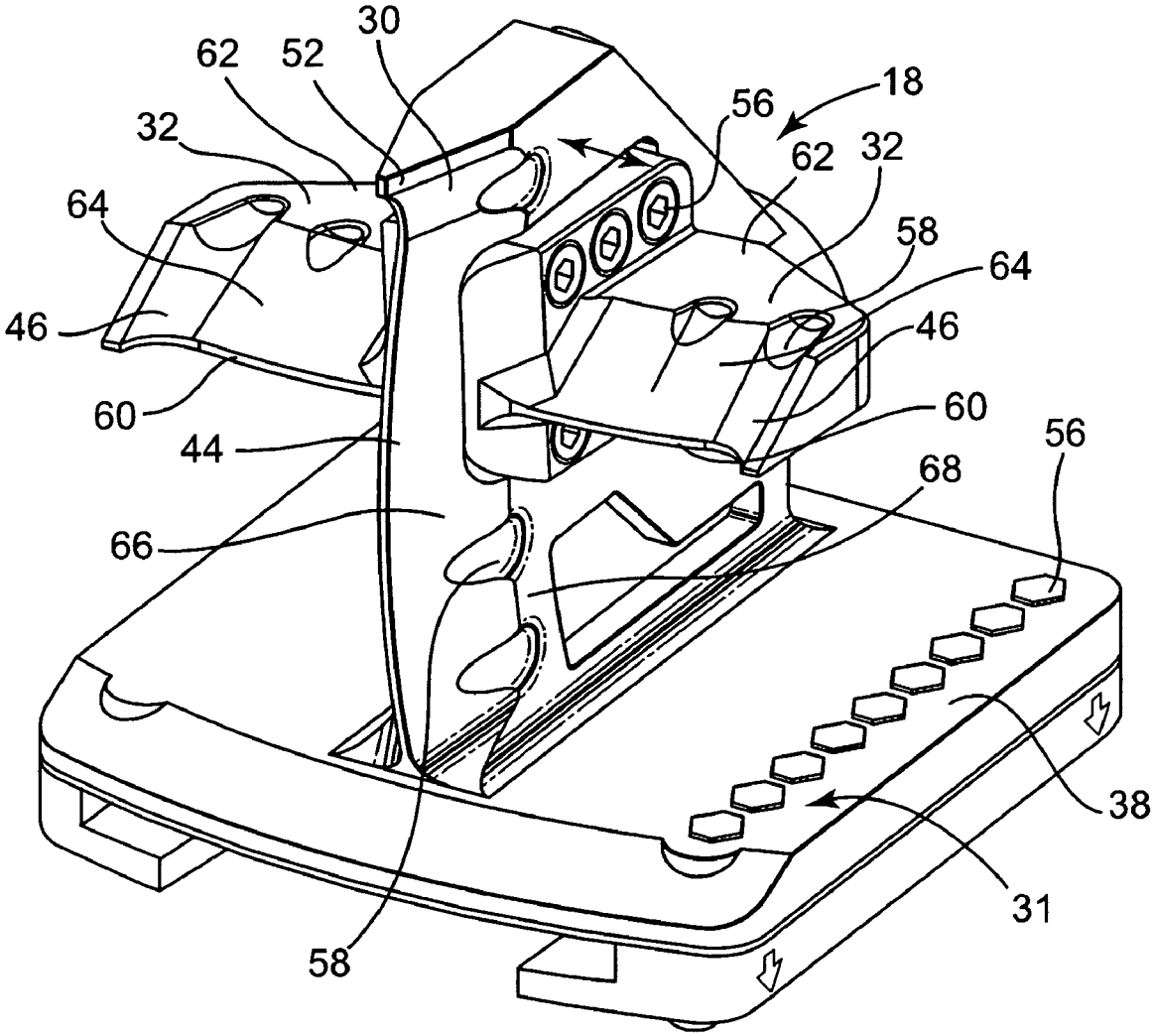
FIG. 8 is a perspective view of the quad wedge of the present invention.

As better illustrated in FIG. 8, blade tip 44 on main blade portion 30 protrudes farther toward splitting zone 14 than curved portions 42 of cutting wings 32. Accordingly, blade tip 44 is the first part of quad wedge 18 to contact a piece of wood being cut. In use, this allows blade tip 44 to be easily lodge in a log when splitting operations are begun. This establishes solid contact, and minimizes the initial force required at the start of the splitting operations.

Referring now to cutting wings 32, end tips 46 are positioned at the outer edges of curved portion 42. These structures are specifically configured to maintain a log or other piece of wood within splitting zone 14. Curved portion 42 also includes a curved center portion 48 that protrudes the least from flat surface 40 at a point adjacent end tips 46 and increasingly protruding such that the farthest protrusion point is a center portion 48 of cuttings wings 32. In this manner, center portion 48 of cutting wings is the second part of quad wedge 18 to contact a piece of wood being cut with end tips 46 being the third portion of quad wedge 18 to contact the wood as drive mechanism 16 pushes quad wedge 18 through the wood. This configuration effectively manages the loads encountered as the quad wedge 18 is advanced into the wood. This configuration also effectively manages the loads encountered as the quad wedge 18 is advanced into the wood.

Figure 6:
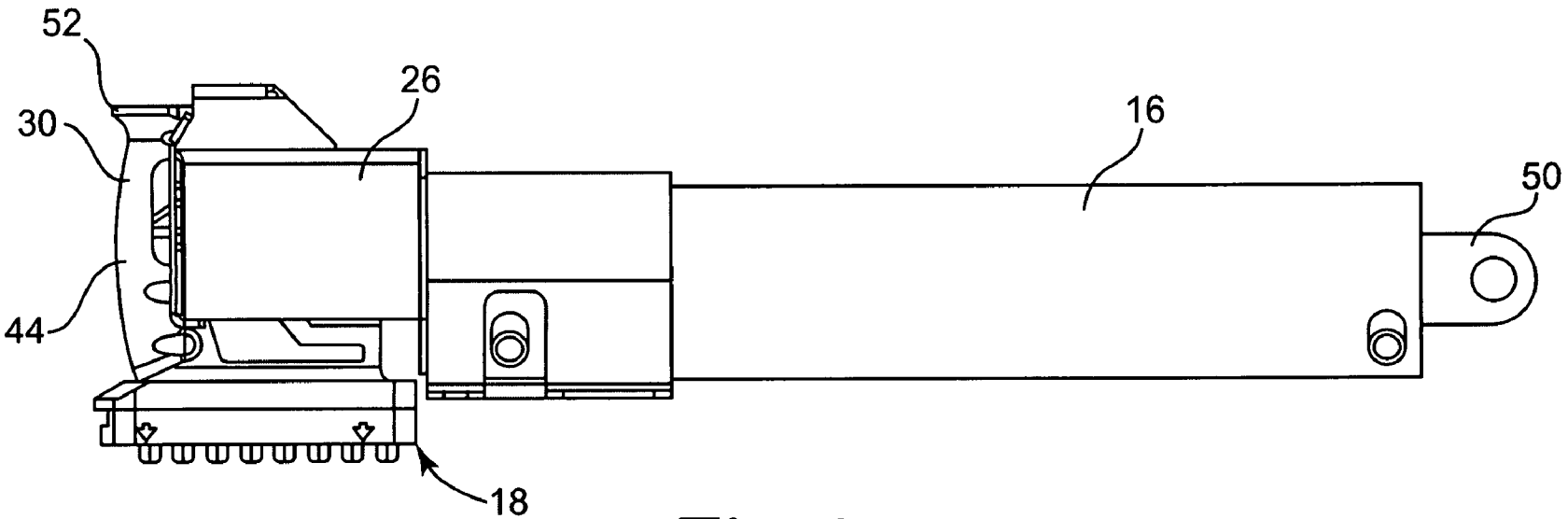
FIG. 6 is a side view of the quad wedge and cylinder assembly in the retracted position.

Referring now to FIG. 6, there is shown more detail regarding the shape of main blade portion 30. Main blade portion 30 includes a curved blade having a wood guide tip 52 at its end opposite slidable base 31. Wood guide tip 52 protrudes to a point slightly behind blade tip 44, such that blade tip 44 is the first part of quad wedge 18 to contact a piece of wood being cut. Wood guide tip 52 is thus the next portion to contact the wood. Curvature of main blade portion 30 in combination with wood guide tip 52 minimizes undesirable moments of force and holds the wood in splitting zone 14 as quad wedge 18 is pushed through the wood by drive mechanism 16. FIG. 6 also depicts a hitch means 50 used to connect drive means 16 to support framework 12. As illustrated, this hitch 50 (or connection mechanism) is positioned in line with the hydraulic cylinder so that forces are centered along an axis of cylinder 16.

Figure 7:
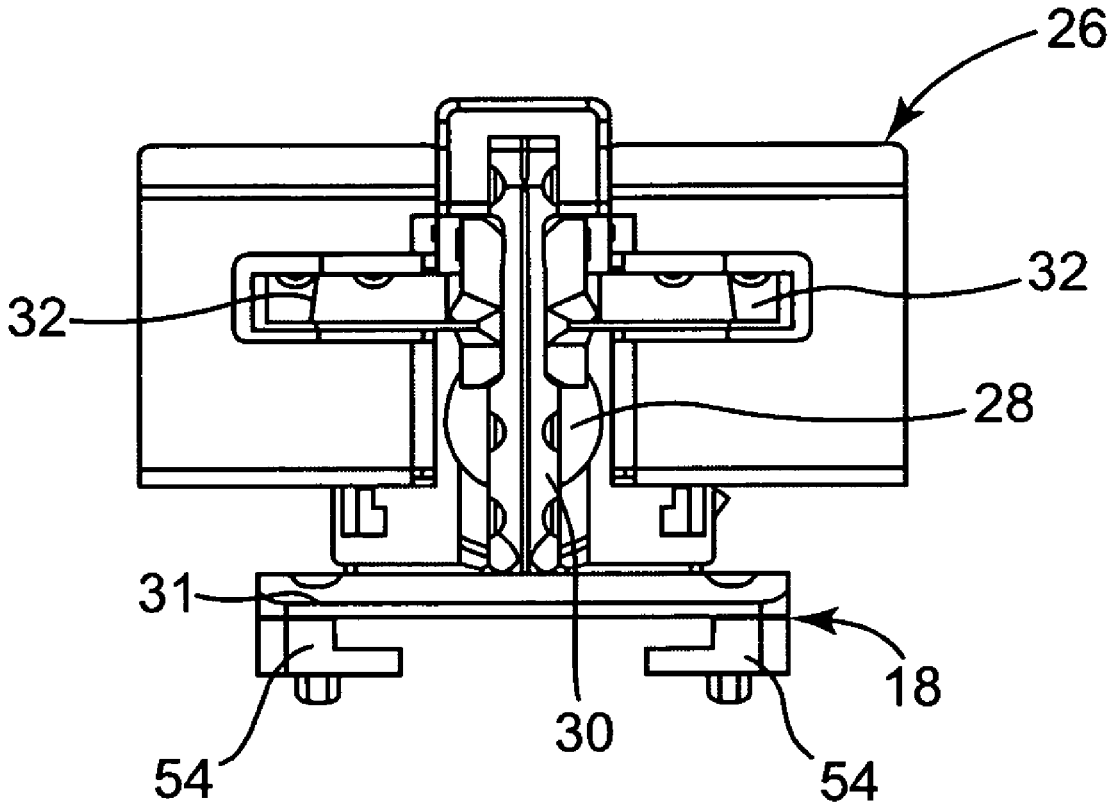
FIG. 7 is a front plan view of the quad wedge in the retracted position as housed within the stripper of the present invention.

FIG. 7 depicts a front plan view of quad wedge 18 in a retracted position within stripper 26. Cutting wings 32 are positioned more than half way above a vertical midpoint of main blade portion 30 and above the point where extendable member 28 is connected to quad wedge 18. This design is also configured to reduce or eliminate undesirable moment of force as quad wedge 18 is pushed through the wood by drive mechanism 16. There is also shown more detail about one embodiment of slidable base member 31. In this embodiment, slidable base 31 includes two opposing L-members 54 that extend longitudinally along and under the outer edges of slidable base 31. L-members 54 are configured to communicate with an I-beam shaped portion of support framework 12 in order to provide support for quad wedge 18 while allowing quad wedge 18 to freely move back and forth through splitting zone 14. Those skilled in the art can appreciate that various shaped support members and framework members can be used, provided that they support quad wedge 18 while allowing quad wedge 18 to freely move back and forth through splitting zone 14.

Referring now to FIG. 8, there is shown a perspective view of quad wedge 18 detailing the design of cutting wings 32. A front portion 60 of cutting wings 32 is much thinner than a back portion 62 and has an upwardly ramped configuration. Specifically, cutting wings 32 also include an upward angle blade 64 from front portion 60 to back portion 62 with elongate dimples 58 cut into the portion of angle blade 64 that meets back portion 60. This configuration for cutting wings 32 also has a substantially flat bottom surface. This is specifically designed to avoid potential for jamming of wood pieces during splitting operations. That is, the flat bottom portion of cutting wings 32 is parallel to the upper side of slidable base 31. This creates a space there between with constant distances and avoids an inherent clogging point.

Main blade portion 30 also has elongate dimples 58 parallel to elongate dimples 58 in cutting wings 32. Main blade portion 30 has opposing angle blades 66 that extend from either side of blade tip 44 out toward opposing back portions 68 of main blade portion 30. These design features, in combination, minimize undesirable moments of force and hold the wood in splitting zone 14 as quad wedge 18 is pushed through the wood by drive mechanism 16.

Figure 9:
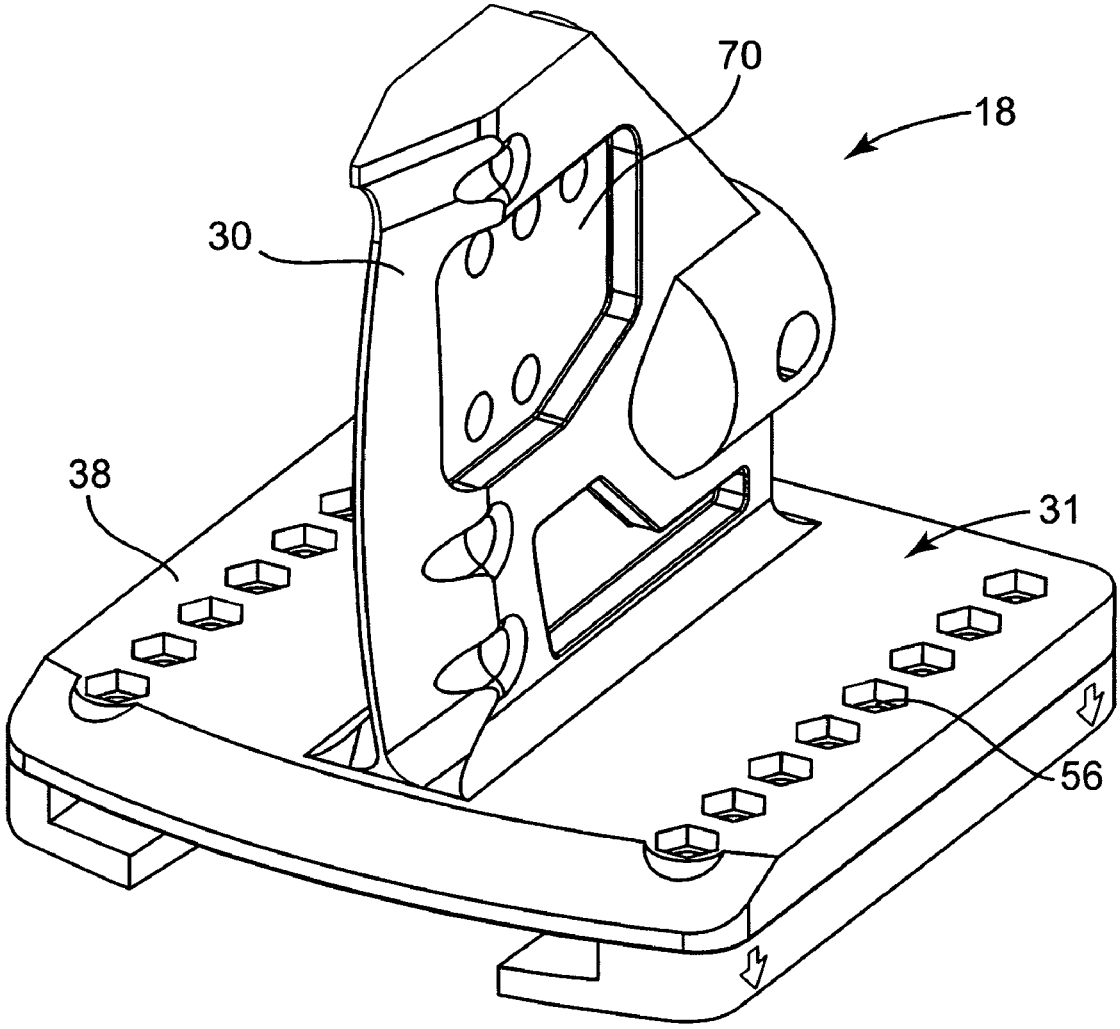
FIG. 9 is a perspective view of the quad wedge of the present invention with the horizontal wings removed and recessed mounting means.

Referring to FIGS. 8 and 9, there are shown mounting means 56 used to secure slidable base 31 to L-members 54. In one embodiment, shown in FIG. 8, the heads of mounting bolts 56 are visible from the top surface 38 of slidable base 31, however are recessed within the structure of slidable base 31. This embodiment avoids resistance as quad wedge 18 is pushed through the wood by drive mechanism 16. While the figures depict bolts as attachment mechanisms, those skilled in the art can appreciate that various mounting structures 56 can be used to secure slidable base to L-members 54, including slidable base 31 integrally including L-member 54.

Referring now only to FIG. 9, quad wedge 18 is shown with cutting wings 32 removed. In one embodiment, cutting wings 32 can be integrally joined to main blade portion 30. In another embodiment, cutting wings 32 can be removably attached to main blade portion 30 so cutting wings 32 can be removed for replacement, sharpening, maintenance, and the like. Those skilled in the art can appreciate that cutting wings 32 can be mounted to main blade portion 30 using any type of mounting means 56, as previously discussed with regard to slidable base 31. The embodiment depicted in FIG.

9 shows recesses 70 in main blade portion 30 that are configured to receive cutting wings 32 in order to mount cutting wings 32 to main blade portion 30. Alternately, cutting wings 32 can be mounted to a surface of main blade portion 30 rather than within recesses 70. Whatever the attachment configuration, care is taken to insure smooth transitions between the various surfaces so that catch points are avoided.

Figure 10:
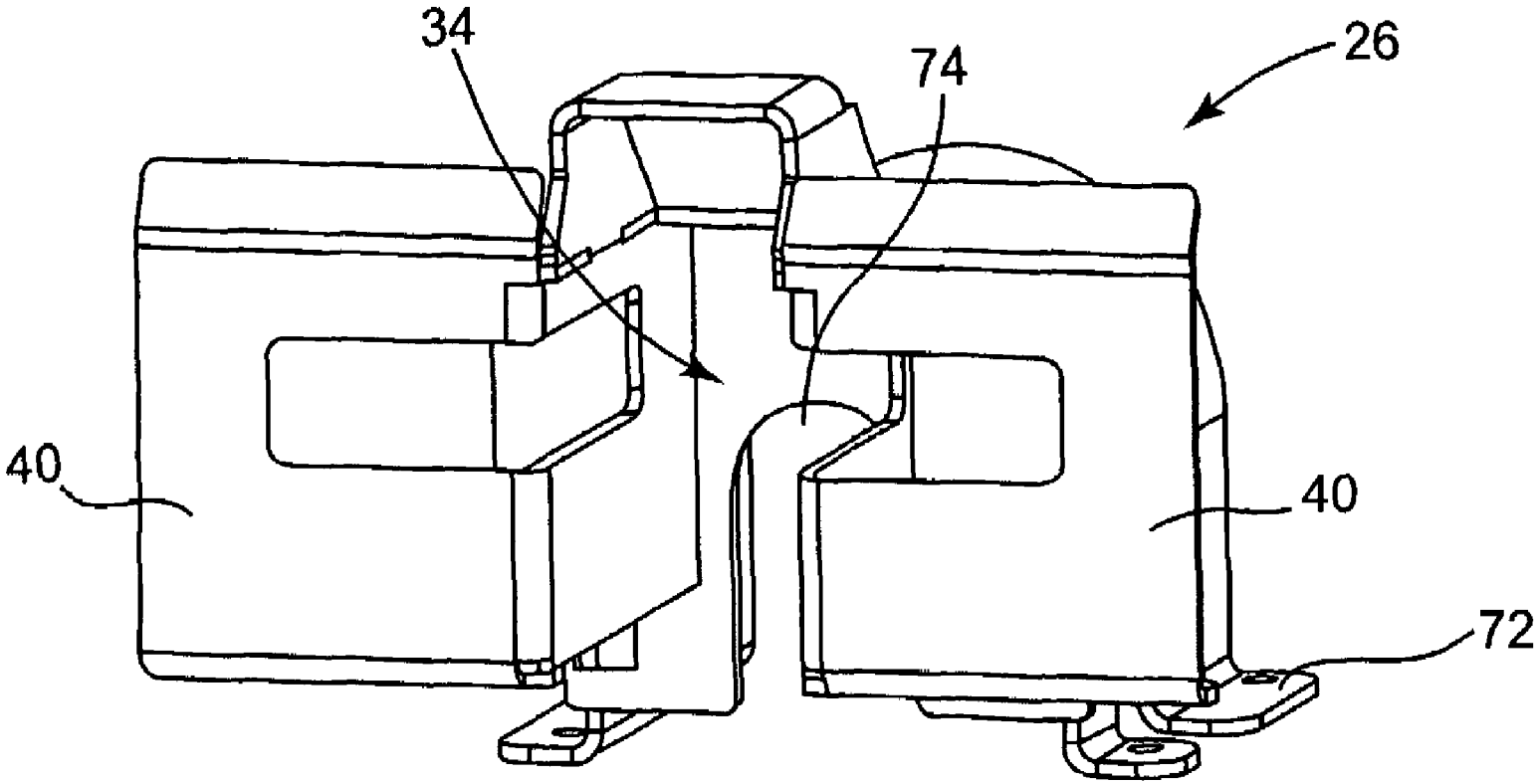
FIG. 10 is a front perspective view of the stripper of the present invention.

FIG. 10 depicts stripper 26 of the present invention in greater detail. As previously discussed with regard to FIG. 3, stripper 26 has a substantially cross-shaped area 34 configured to receive main blade portion 30 and cutting wings 32. Stripper 26 also has mounting brackets 72 for attaching stripper 26 to support framework 12. While not specifically illustrated, stripper 26 is directly attached to cylinder 16, so that forces can be easily managed. More specifically, forces against the stripper which are created when the cylinder is retracted are transmitted directly to the cylinder housing due to the direct connection between these two components. Again, as discussed above, various mounting means 56 can be used to secure stripper 26 on log splitter 10, but care must be taken to manage stripping forces. Stripper 26 also has an extendable member receiving opening 74 configured such that extendable member 28 can freely move back and forth there within.

In operation, referring again to FIGS. 1-3, log splitter 10 is positioned in the vertical or horizontal orientation depending on the size and shape of a piece of wood being cut. In addition, depending on the size and shape of the wood and the desired number of finished, split pieces, cutting wings 32 can be mounted to main blade portion 30 or removed. The wood is then placed against stop 20. An operator initiates splitting process by manual or automated extension of extendable member 28 from stripper 26 through splitting zone 14 and into the wood. If the wood catches on quad blade 18, the operator can reverse the direction of extendable member 28 to retract quad wedge 18 within stripper 26 thereby dislodging the wood from quad wedge 18.

It is contemplated that features disclosed in this application can be mixed and matched to suit particular circumstances. Various other modifications and changes will be apparent to those of ordinary skill in the art without departing from the spirit and scope of the present invention. Accordingly, reference should be made to the claims to determine the scope of the present invention.

What is claimed is:

1. A log splitter, comprising:

a framework defining one side of a splitting zone, wherein a log to be split is placed within the splitting zone and wherein the framework is positionable in either a horizontal orientation or vertical orientation;

a drive mechanism attached to the framework, the drive mechanism further having a log stripper attached to the drive mechanism;

a stop attached to the framework and positioned at a first end of the splitting zone so as to contain the log to be split; and a four-way splitting wedge attached to the drive mechanism and movable through the splitting zone in a direction toward the stop, the four-way splitting wedge having a main blade portion with a continuous cutting edge positioned to be facing the stop, the four-way splitting wedge further having a cutting wing also having a continuous cutting edge substantially perpendicular to the main blade portion and also facing the stop;

wherein the log stripper having a main surface facing the stop and including an opening therein configured to receive the four-way splitting wedge when the drive mechanism is moved to a retracted position.

2. The log splitter of claim 1 wherein the framework is a beam having a main surface to create a first side of the splitting zone, and wherein the splitting blade is Slidably attached to the framework.

3. The log splitter of claim 1 wherein the cutting wing comprises a pair of cutting wings, each cutting wing having a cutting edge that is recessed back from the main blade portion of the splitting wedge.

4. The log splitter of claim 3 wherein the pair of cutting wings are removable.

5. The log splitter of claim 3 wherein the cutting wings further have blade tips for containing the log during splitting operations, the blade tips existing along cutting edge of the wings and at and end of the cutting wing opposite the main blade and form an outwardly extending point.

6. The log splitter of claim 5 wherein the outwardly extending points of the cutting wing blades are positioned in a plane perpendicular to the direction of travel which is behind the cutting edge of the main blade.

7. The log splitter of claim 5 wherein the cutting wings each include a retaining groove adjacent to the blade tips.

8. The log splitter of claim 1 wherein the drive mechanism is a hydraulic cylinder attached to the framework with it piston attached to the quad wedge.

9. The log splitter of claim 8 wherein the piston is inserted into a recess in the quad wedge opposite the cutting edge and at a location substantially centered along the vertically extending main blade.

10. The log splitter of claim 9 further having a log stripper attached to the hydraulic cylinder and having an opening therein configured to receive the four-way splitting wedge when the piston is retracted.

11. The log splitter of claim 1 wherein the main blade and the cutting wings each include at least one dimple.

12. The log splitter of claim 1 wherein the cutting wings have a flat bottom surface facing the framework.

13. The log splitter of claim 1 wherein the main blade includes a curved leading edge and a wood guide tip at an upper portion thereof, the wood guide tip including a point extending toward the stop, while being positioned behind the extreme edge of the curved leading edge.

14. The log splitter of claim 13 further including a pair of retaining grooves positioned adjacent the wood guide tip to retain a log during cutting.

15. A four-way log splitter for effectively splitting a log placed in a splitting zone, the four-way log splitter comprising:

a stop positioned at one end of the splitting zone for retaining the log;

a drive mechanism positioned adjacent the splitting zone opposite the stop, the drive mechanism further having a loci stripper attached to a side of the drive closest to the stop, the log stripper including a recess therein; and a four-way wedge attached to the drive mechanism and movable through the splitting zone in a direction toward the stop, the four way wedge having a main blade portion configured to face the stop as it is moved through the splitting zone, and a pair of cutting wings extending outwardly from the main blade in a perpendicular orientation, each cutting wing having a blade edge similarly configured to face the stop as it is moved through the splitting zone, the wedge configured to enter the stripper recess as the drive mechanism is retracted.

16. The four-way splitter of claim 15 wherein the drive mechanism is a hydraulic cylinder having a piston attached to the four-way wedge and wherein the piston is recessed into a cavity in the four-way wedge on a side opposite the main blade.

17. The four-way splitter of claim 15 wherein the main blade has a curved cutting edge at a leading portion, and wherein a blade edge of the cutting wings is also curved, the blade edge of the cutting wings further being recessed back from the curved cutting edge of the main blade, such that a central portion of the curved cutting edge will encounter the log before any other portion of the four-way wedge.

18. The four-way splitter of claim 17 wherein the main blade includes a wood guide tip at an upper portion thereof, the wood guide tip including a pointed portion extending toward the stop, the pointed portion positioned behind the central portion of the cutting blade.

19. The four-way splitter of claim 15 wherein the main blade includes a wood guide tip at an upper portion thereof, the wood guide tip including a pointed portion extending toward the stop.

20. The four-way splitter of claim 15 wherein the stop and the drive mechanism are attached to a framework, and wherein the four-way wedge is coupled to the framework so that the framework guides the four-way wedge through the splitting zone.

21. The log splitter of claim 20 wherein the framework is supported to be rotatable, such that the framework can be positioned in either a horizontal orientation or a vertical orientation.

22. The log splitter of claim 15 wherein four-way wedge includes a base portion having a substantially planar for supporting the main blade, the cutting wings each having a flat bottom surface which is substantially parallel with the base portion.

23. A log splitter for achieving multiple splits in a log, the log splitter comprising:

a support structure;

a framework coupled to the support structure such that the framework can be moved between a vertical orientation and a horizontal orientation;

a stop attached to the framework;

a drive system attached to the framework having a movable driven portion which moves relative to the framework; and a wedge coupled to the movable portion of the drive system and movable toward the stop by the drive system, the wedge having a main blade portion extending upwardly from the framework and having a curved leading edge facing the stop, the wedge further having a pair of cutting wings extending outwardly and also having a cutting edge facing the stop, the cutting edge of the cutting wings positioned back from the leading edge so that only a portion of the curved leading edge of the main blade encounters the log first as the wedge is moved toward the stop and the curved leading edge continues to encounter an increasing amount of the log during advancement; and a log stripper attached to the drive system and having a stripper surface with an opening therein configured to receive the wedge when the drive system is moved to a retracted position.

24. The log splitter of claim 23 wherein the pair of cutting wings are removable.

25. The log splitter of claim 23 wherein the cutting wings further have blade tips for containing the log during splitting operations, the blade tips existing along the cutting edge of the wings and at and end of the cutting wing opposite the main blade and form an outwardly extending point.

26. The log splitter of claim 25 wherein the outwardly extending points of the cutting wing blades are positioned in a plane perpendicular to the direction of travel which is behind the leading edge of the main blade.

27. The log splitter of claim 23 wherein the drive system is a hydraulic cylinder attached to the framework with the piston attached to the quad wedge.

28. The log splitter of claim 27 wherein the piston is inserted into a recess in the wedge opposite the leading edge and at a location substantially centered along the main blade.

29. The log splitter of claim 23 further having a log stripper attached to the hydraulic cylinder and having an opening therein configured to receive the four-way splitting wedge when the piston is retracted.

30. The log splitter of claim 23 wherein the cutting wings have a flat bottom surface facing the framework.

31. The log splitter of claim 23 wherein the main blade includes a wood guide tip at an upper portion thereof, the wood guide tip including a point extending toward the stop, while being positioned behind the extreme edge of the curved leading edge.

32. The log splitter of claim 31 further including a pair of retaining grooves positioned adjacent the wood guide tip to retain a log during cutting.

* * * * *